US007921604B2

(12) United States Patent
Lino

(10) Patent No.: US 7,921,604 B2
(45) Date of Patent: Apr. 12, 2011

(54) STORM PROOF ALUMA-FOAM HOUSING UNIT

(76) Inventor: Siaosi Kaihau Lino, Bradenton, FL (US)

( * ) Notice: Subject to any disclaimer, the term of this patent is extended or adjusted under 35 U.S.C. 154(b) by 1466 days.

(21) Appl. No.: 11/331,681

(22) Filed: Jan. 4, 2006

(65) Prior Publication Data

US 2009/0113812 A1 May 7, 2009

(51) Int. Cl.

| | |
|---|---|
| ***E04H 9/00*** | (2006.01) |
| ***E04H 9/02*** | (2006.01) |
| ***E02D 27/00*** | (2006.01) |
| ***E02B 17/08*** | (2006.01) |
| ***B63C 1/02*** | (2006.01) |
| ***B63B 35/44*** | (2006.01) |

(52) U.S. Cl. ..... 52/1; 52/167.4; 52/169.9; 405/196; 114/45; 114/264

(58) Field of Classification Search ..... 52/1, 79.1, 52/167.4, 67, 169.9; 405/196, 229, 249; 114/45, 123, 264

See application file for complete search history.

(56) References Cited

U.S. PATENT DOCUMENTS

| | | | | |
|---|---|---|---|---|
| 2,715,756 | A * | 8/1955 | Carver | 405/229 |
| 4,197,597 | A * | 4/1980 | Toms | 4/300 |
| 4,228,788 | A * | 10/1980 | Moeser | 123/437 |
| 5,347,949 | A * | 9/1994 | Winston | 114/264 |
| 5,647,693 | A * | 7/1997 | Carlinsky et al. | 405/229 |
| 6,050,207 | A * | 4/2000 | Mays | 114/45 |
| 6,347,487 | B1 * | 2/2002 | Davis | 52/1 |
| 6,926,468 | B2 * | 8/2005 | Sehl | 405/219 |
| 2002/0197113 | A1 * | 12/2002 | Legleux | 405/196 |
| 2003/0047209 | A1 * | 3/2003 | Yanai et al. | 136/291 |
| 2004/0261338 | A1 * | 12/2004 | De Cherance | 52/292 |
| 2006/0162636 | A1 * | 7/2006 | Lawrence | 114/230.13 |

* cited by examiner

*Primary Examiner* — Eileen Lillis
*Assistant Examiner* — Ryan D Kwiecinski

(57) ABSTRACT

An aluminum-foam structural housing unit that is storm-proof, self-contained, and built to withstand natural disaster conditions resulting from hurricanes, tornadoes, earthquakes, and fire, and then assist its inhabitants immediately thereafter when interruptions in public utility system service can be experienced. The combined use of aluminum alloy and foam as its building materials gives the unit its great strength, as well as the versatility needed to face natural disaster conditions while providing absolute resistance to heavy winds, flooding, earthquake and fire. Since the unit is buoyant, during flooding conditions it lifts from the ground and is guided by vertical poles to maintain a horizontal orientation. The unit also automatically disconnects from public utility systems as lifting occurs, and it then provides its inhabitants with self-contained sources of water, electrical energy, and sewage management. Thus, the unit is designed to adjust to the flow of nature, instead of working against it.

20 Claims, 2 Drawing Sheets

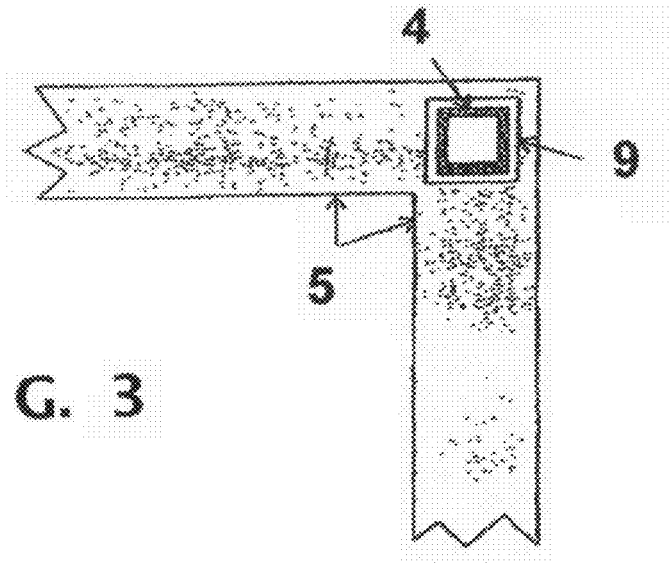
FIG. 3
FIG. 4
FIG. 6
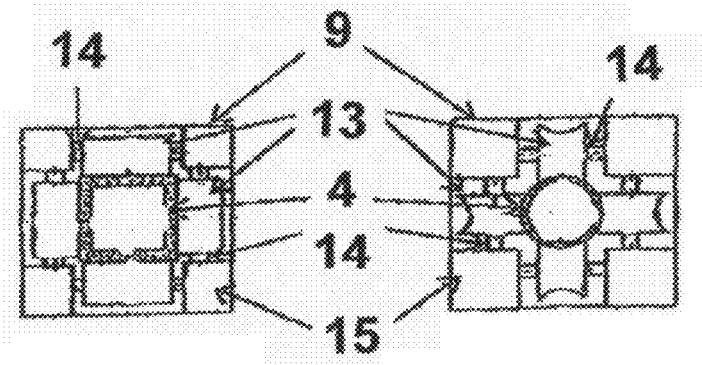
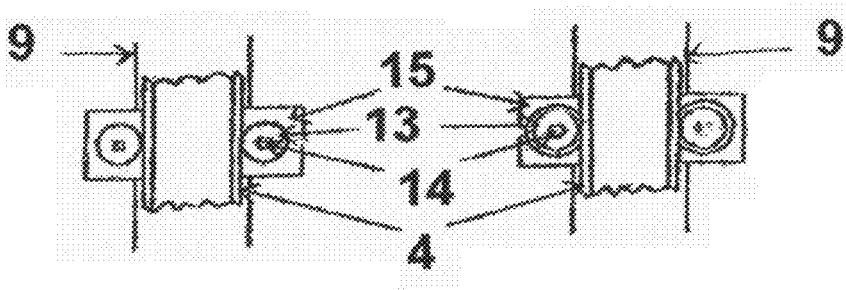
FIG. 5
FIG. 7

STORM PROOF ALUMA-FOAM HOUSING UNIT

BACKGROUND

1. Field of the Invention

This invention relates to buildings located in areas exposed to flooding, for example due hurricane or other natural or man-made conditions, which can become uninhabitable or dangerous after the flooding has subsided. Past experience with flooding and hurricane disasters show that evacuation of inhabitants in advance of a threatening disaster may be prevented by traffic congestions, unusually fast onset of the flooding, broken dams, coincidence of heavy winds, faulty predictions, and/or delayed evacuation orders by authorities, or simply as a result of the inhabitants waiting too long with their move to a safer area. All these factors have been clearly demonstrated in connection with past flooding related to hurricanes and tsunamis. Other experience demonstrates that extraordinary conditions often result from natural disasters and have a tendency to last many weeks, sometimes months, thus the inhabitants of areas exposed to flooding as a result of hurricane or other natural or man-made conditions many times will have to wait long time periods before public utilities, such as drinking water, and electricity supply, and sewer system, are restored. In the interim, lack of a good source of food, drinking water, electricity, and other public utilities can lead to illness and loss of human life.

2. Description of the Related Art

Housing in areas exposed to flooding are commonly connected in a rigid manner to a foundation, and cannot be lifted by the rising floodwater. Furthermore, as they become flooded, not only are they adversely affected, stored resources required for human survival also become destroyed. Even permanently elevated buildings which provide escape to upper levels, and ultimately to the roof, are not self-contained and thereby do not provide a good opportunity for the survival of inhabitants beyond the time period of a few days. Lack of portable water, lack of electrical energy, and the rapid accumulation of sewage in the inhabitants' surroundings quickly weaken the resistance of surviving inhabitants against infections, exhaustion, and deterioration of health. No known self-contained floating house unit is known that has all of the features and advantages of the present invention.

SUMMARY OF THE INVENTION—OBJECTIVES AND ADVANTAGES

The primary objective of this invention is to provide a storm-proof self-contained floating housing unit that is able to withstand forces caused by the heavy winds and flooding experienced during hurricanes, tornadoes, earthquakes, fire, and other natural and man-made disasters. The key materials that make this building possible are a combination of aluminum and foam, which together give the building its strength and durability, as well as insulation, floatation and heat resistant. The housing unit structure consists of aluminum walls with foam pumped in between the aluminum walls throughout the whole building. The foundation of the structure consists of the same materials with air tubing inside which adds to the structure's buoyancy. The present invention housing unit is guided with vertical poles in its corners that allow it lift from the ground during flooding and remain above its concrete pad without drifting away. The base in the lower region of the building contains chambers and spaces for water, electrical energy, and sewer facility that are essential for habitation, and further has a low specific weight and density creating buoyancy exceeding the total weight of the building's structure and payload, ensuring that the floor of the building always remains above the rising floodwater. Payload is defined as the weight of all inhabitants, removable equipment, furniture, foodstuff and materials required for permanent habitation. Other features of the invention will be described in connection with the drawing.

BRIEF DESCRIPTION OF THE SEVERAL VIEWS OF THE INVENTION

FIG. 1 is a top view of a possible layout of a self-contained floating building in the most preferred embodiment of the present invention.

FIG. 2 is a side view of a building in the most preferred embodiment of the present invention showing the building positioned above a concrete slab on the ground, with several spacers separating a broken line representation of the building's bottom contour L1 from the concrete slab at normal water table conditions designated by W1, with a hypothetical flood condition water level designated by W2 being shown above W1, with the bottom contour of the building during the flood condition represented by the designation L2, several vertically-extending poles are also shown between the concrete slab and the elevated structure.

FIG. 3 is an enlarged view of a vertical post in the corner of the vertically-deployable structure in the most preferred embodiment of the present invention that is encircled and marked with the letter "B" in FIG. 1.

FIG. 4 is an enlarged view of one of the rolling contact units for vertically-extending poles with rectangular cross-section that can used in the most preferred embodiment of the present invention to ensure smooth relative movement between the building structure and the poles.

FIG. 5 is an enlarged view of one of the rolling contact units for vertically-extending poles with rectangular cross-section that can used in the most preferred embodiment of the present invention to ensure smooth relative movement between the building structure and the poles.

FIG. 6 is an enlarged view of one of the rolling contact units for vertically-extending poles with circular cross-section that can used in the most preferred embodiment of the present invention to ensure smooth relative movement between the building structure and the poles.

FIG. 7 is an enlarged view of one of the rolling contact units for vertically-extending poles with circular cross-section that can used in the most preferred embodiment of the present invention to ensure smooth relative movement between the building structure and the poles.

DETAILED DESCRIPTION OF THE INVENTION

Figure 1:
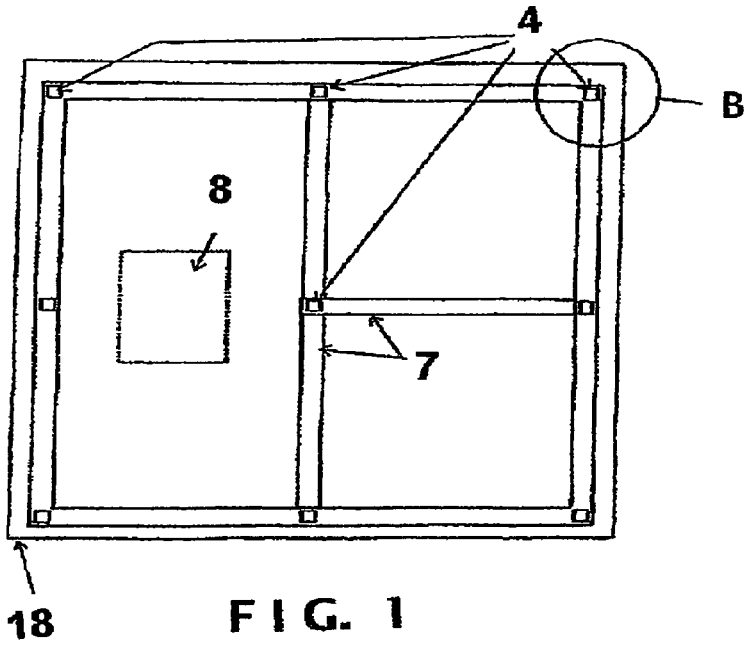
Figure 2:
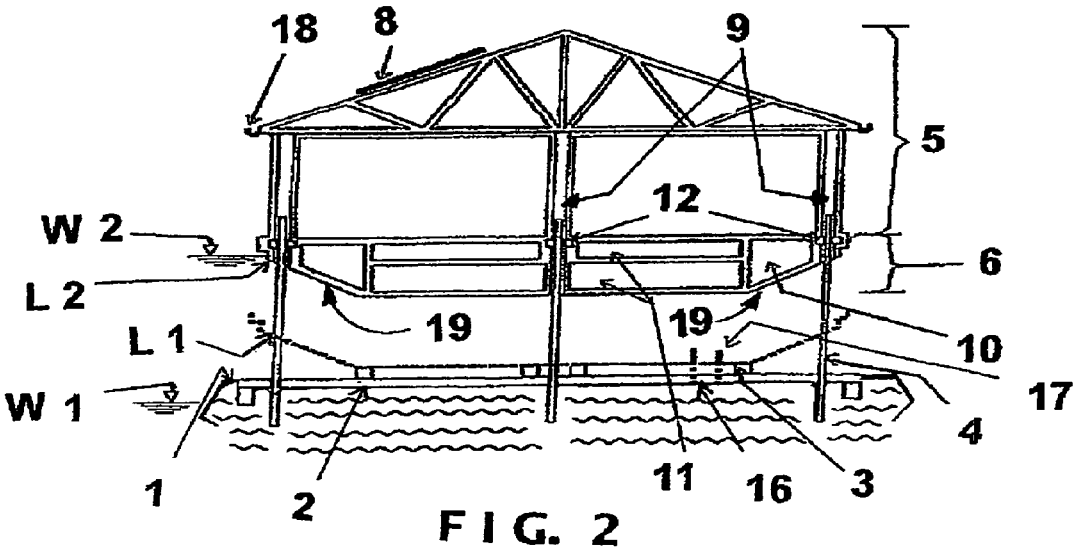

FIGS. 1 and 2 show a one possible layout of a present invention self-contained floating building in accordance with the description herein, respectively in horizontal projection and vertical cross-section. FIG. 2 shows the building in an elevated position as it would be viewed during flood conditions, with the flood condition water level, W2, being much higher than the normal water table, which is also identified in FIG. 2 by the alpha-numeric designation of W1.

The ground 1 shown in FIG. 2 is covered by concrete slab 2 having several supporting spacers 3. In addition, FIG. 2 shows three poles 4 firmly inserted through concrete slab 2 and precisely positioned in spaced-apart array along the side of the present invention building facing an observer. In contrast, nine poles 4 are shown in FIG. 1 in spaced-apart array throughout the most preferred embodiment of the present invention self-contained floating building, three observed from each side and a centrally located post 4 in the middle. In FIG. 2, line L1 represents the bottom contour of the present invention building during normal conditions when it is resting on the spacers 3 above concrete slab 2. When flooding raises the water level above ground 1 to elevation W2, the present invention floating building's bottom contour line moves to the elevated position marked with the alpha-numeric designation of L2. The lower region of the present invention building structure, its base 6, provides all the necessary buoyancy to exceed the total weight of the building's structure and payload, ensuring that the floor of the building always remains above the rising floodwater. Although not shown in the illustrations, payload is defined as the weight of all inhabitants, removable equipment, furniture, foodstuff and materials required for permanent habitation. The shape of the lower region of the present invention building structure, also referred to herein as base 6, may be similar to a barge as shown in FIG. 2 where the bottom of base 6 rises toward each of its perimeter edges. The wedge-like shape of water in this perimeter area will reduce horizontal forces between the flood current and the present invention building structure, and thereby reduce the horizontal forces required to maintain the position of the present invention building over concrete slab 2.

The horizontal positioning of the present invention building at any flood water level (W2 or other) is provided by vertically-extending poles 4, and the building will be guided in relation to these poles 4 without interference to the changing vertical position of the building. The choice of cross-section for poles 4 is not limited by this invention. It is contemplated that both the rectangular tube and round cross-section would be favored for practical and economical reasons. The rectangular-shaped hollow tube spaces 9 that permit the present invention building structure to slide up and down in relation to the fixed poles 4 would also having a corresponding structure, rectangular, round, or other cross-section. The present invention building structure, marked in FIG. 2 as upper region 5 and base 6, must be a rigid unit able to resist both flexion and torsion forces without significant deformation. The number 7 indicates he possible locations of internal walls, also called separations. It is a major advantage, if the internal walls 7 are rigid, tightly connected to the external walls and contribute to the combined rigidity of the building's upper region 5. High structural rigidity is essential, because a deformed building structure would adversely interact with poles 4 when the building is lifted by the flood waters, and could prevent the desired amount of lifting. For example, as shown in FIG. 3, the present invention building structure may be equipped with rectangular-shaped hollow tube spaces 9 that permit the building structure to slide up and down without interference in relation to fixed poles 4 also having a rectangular cross-section. FIG. 3 shows for example a possible solution for the horizontal cross-section in one corner of the present invention building wherein a rectangular hollow tube 9 surrounds the pole's 4 rectangular cross-section, the same corner indicated in FIG. 1 by the letter "B". A minimum all around gap must be maintained between the hollow tube 9 and the pole 4 to avoid rubbing and possible damage.

In order to ensure a smooth relative movement between the building structure 5 and 6 and the poles 4, rolling contact units (13+14) in accordance with FIGS. 4, 5, 6 and 7 are a suggested feature of the present invention. FIGS. 4 and 5 show the rolling contact units (13+14) configured for poles 4 with rectangular cross-section, while FIGS. 6 and 7 are drawn to illustrate a round pole 4 application. A rolling contact unit consists of four rollers 13 centered on shafts 14. In the examples illustrated in FIGS. 4-7, the desired positioning of a pole 4 within its associated hollow tube 9 is shown to include four rollers 13 per rolling contact unit. Nevertheless, other number of rollers 13 may be selected without limiting this invention. FIG. 2 shows only one rolling contact unit (13+14) per pole 4. Two or more rolling contact units (13+14) may be used per pole 4 to achieve a more precise positioning of pole 4 within its associated hollow tube 9.

FIG. 2 shows that the lower region of the present invention building structure, its base 6 contains several chambers (10 and 11). These chambers (10 and 11) may have different purposes. Some of the chambers (10 and 11), for example, those chambers marked with the number 10 and located near the perimeter of base 6, may be air or foam filled spaces providing the necessary buoyancy for the building as a whole. In the alternative, other chambers 11, may be used as septic tank, or as a drinking water reservoir, or as places for storing electrical batteries or fuel (not shown). Partitions between these chambers (10 and 11) are beneficial also from the point of view of structural rigidity, which as mentioned above is important to the present invention. FIG. 2 also shows base 6 having non-arcuate upwardly tapered lateral edges 19 under the chambers 10 located near the perimeter edge of base 6. The wedge-like shape of water adjacent to non-arcuate perimeter edges of base 6 will reduce horizontal forces between the flood current and the present invention building structure, and thereby reduce the horizontal forces required to maintain the position of the present invention building over its concrete slab 2. FIGS. 1-3 show the interior and exterior wall surfaces between which foam is pumped, forming strong compression and adhesion as it dries out, thereby bonding the interior and exterior wall plates together and creating a very solid and stable wall structure.

Furthermore, rain water collected by the gutters 18 shown in FIG. 2 will be led into a water reservoir, which although not individually marked in FIG. 2 will occupy at least one of the four chambers 11 visible in FIG. 2, providing the emergency water supply needed by present invention inhabitants after flood waters have receded. Photovoltaic panels 8 on the roof (shown in FIG. 2, but not individually marked by numerical designation) will be used to charge the earlier mentioned electrical batteries, which are preferably located in the chambers 11 to lower the center of gravity of the present invention building and increase its stability. The direct current (DC) power available from any batteries used can be transformed through inverters into 110, 220 or other needed voltages. Alternate electric energy sources could include wind driven turbine-generator sets with engine driven generators. The fuel for the engine driven generators, as well the engine driven generator sets, should preferable be located in the lower region of the present invention building, for example in one of the chambers 11 in base 6. However, the most likely solution for providing electrical power to the present invention building would be photovoltaic panels 8 placed upon the roof of the present invention building (one example of which is shown in FIGS. 1 and 2), due to their simplicity and minimal maintenance. In accordance with this invention, the stored electrical energy will be used among other applications to activate sump pumps (not shown) for removing water accumulation that is very likely to occur in some lower locations of the present invention building or its base 6. Furthermore, it is contemplated for this invention to have an automatic electronic control system that will operate pumps to transfer water, waste in the septic tank, or engine fuel between different chambers (10+11) in base 6 in order to maintain a balanced, horizontal positioning for the present invention building, while compensating for the changing flood water currents and wind pressure.

With use of this self-contained present invention building, the survival of its inhabitants is greatly improved as a result of having their own energy supply and water supply, as well as through the hygienic and autonomous storage of the sewage. The features described above for the present invention building structure intend to serve this purpose. A great advantage of the described self-contained and floating building structure system, is that the transition from regular operation to emergency operation can occur almost instantaneously when the present invention building begins to separate form the ground and rise with the surrounding flood water. If the present invention building is supplied with external water, electricity, and sewer utilities under normal conditions, these connections (shown by the numbers 16 and 17 in FIG. 2) must be disconnected under flood or other disaster conditions. Some of these connections may be automatically severed, and connection openings automatically closed, when the present invention building is lifted by the rising water. Some other connections may be de-activated manually, by an automatic control, including electrical control systems and pneumatic control systems. The layout and choice of the automatic disconnection and closing devices is not a limiting factor for this invention.

From engineering point of view, the contradicting requirements on high structural rigidity and minimum weight can be achieved in accordance with this invention by using materials with low specific density, such as aluminum alloys and composites. Application of foams of plastic and similar materials filing the empty structural spaces (for example in separating walls 7) in building 5, as well as in base 6 to separate the chambers 10 and 11, with provide strong adhesion between these fill materials and the structural materials to increase the mechanical rigidity and stability of the present invention structure. A secondary objective of the foam is to fill empty spaces which otherwise might become filled by intruding leakage. The leakage water would reduce the building's buoyancy and disturb the balance of the building as a whole. The two main components in the present invention building are its structural components and the space filing foam, and each shall be chosen to achieve the highest possible corrosion resistance and minimal deterioration due to aging factors, such as temperature, stresses, and other influences. Use of an aluminum alloy as building material is the attractive choice. However, it must targeted, that the aluminum alloy selected for use must have an optimum combination of strength and corrosion resistance, as the floodwater may have different concentrations of salt and other materials greatly influencing the fluid's corrosiveness. Conversely, exposure to the corroding fluid may be regarded' as a temporary and/or extraordinary event. Furthermore, the structural materials in lower region of the building, base 6, and in other upper parts 5 of the present invention building structure may be different. For example, the lower region, the base 6, which will be submerged into the flood water, may be built of steel while the upper parts of the building 5 can be made of aluminum alloys. Another preferred feature of this invention is for all surfaces of the building and poles 4 to be equipped with a corrosion resistant coating.

What is claimed is:

1. Building structure primarily for use in areas exposed to flooding, said building structure comprising:

a storm proof self-contained floating housing unit having an upper region with a roof and a base downwardly depending from said upper region that provides a non-trussed floor and air tubing under said floor configured and positioned to add buoyancy to said housing unit;

said upper region and said base both having foam filled walls configured with sufficient pumped in foam to provide optimum strength and durability to said housing unit;

said walls internally containing secure guides for vertical poles used for upward deployment of said housing unit in response to rising water around it, said foam being pumped in between said interior and exterior wall surfaces and surrounding said guides to securely position them within said walls for said housing unit deployment use;

said pumped in foam further configured to provide insulation, floatation, and heat resistance for said housing unit that allows it to withstand heavy winds and flooding from hurricanes, as well as tornadoes, earthquakes, and fire;

said base also providing a bottom surface having upwardly tapered non-arcuate lateral edges and chambers and spaces under said floor configured for water, electrical energy, and sewer accommodation;

said housing unit walls also comprising corners and vertically-extending guides positioned in said corners that are securely fixed in place in said upper region and in said base by said pumped in foam, with each said fixed guide within said aluminum and foam filled walls having a vertical pole centrally therein that is configured and positioned to allow said housing unit to deploy upwardly from the ground during flooding without lateral drift relative to the ground;

each of said guides also having at least one rolling contact unit secured to it that is adapted to provide smooth movement of said housing unit during its upward deployment;

said roof further comprising photovoltaic panels that are connected to said electrical energy accommodation means in said base for distribution of electrical power that helps said housing unit to function independently when needed; and said base also providing a low weight and density that creates buoyancy exceeding the total weight of said building unit, its contemplated inhabitants, and contents anticipated for habitation within said building unit so that said floor will always remain above rising floodwater.

2. Building structure in accordance with claim 1 wherein said roof is made from the same material combination of aluminum and pumped in foam used for said walls.

3. Building structure in accordance with claim 2 wherein said vertical poles positioned within said corners of said housing unit are rigidly founded in the ground below said housing unit, and wherein said guides adjacent to said vertical poles that are adapted to interact with said vertical poles and maintain said housing unit in a substantially level orientation when water around said housing unit rises and lifts said housing unit from the ground during flooding, said rigidly founded vertical poles and said guides also being configured to act in concert with said upwardly tapered perimeter edges of said bottom surface of said base to prevent said building structure from experiencing lateral drift.

4. Building structure in accordance with claim 3 wherein said vertical poles each have an exterior surface and also further comprising rolling contact units each having at least one roller with a shaft supported rigidly in relation to said housing unit so as to position said at least one roller for rolling on said exterior surface of said at least one vertical pole in a manner that achieves a precise and smooth vertical movement of said housing unit in relation to said at least one vertical pole.

5. Building structure in accordance with claim 4 wherein said photovoltaic panels are configured to generate direct current and further comprising batteries in said base that are adapted for storage of said direct current generated by said photovoltaic panels.

6. Building structure in accordance with claim 5 further comprising at least one waxer collection chamber and said roof having rain water collection gutters and channels leading rain water falling on said roof into said at least one water collection chamber.

7. Building structure in accordance with claim 6 further comprising at least two of said water collection chambers and at least one pump adapted for transfer of sufficient water from one of said chambers to the other in order to maintain said building structure in a level and stable orientation.

8. Building structure in accordance with claim 4 further comprising public utility connections for electrical, water and sewer that are adapted for automatic disengagement when said housing unit deploys upwardly in response to rising flood water.

9. Building structure in accordance with claim 8 wherein said housing unit further comprises structural materials in said upper region that are different from structural materials used in said lower region and which are also adapted to meet the different corrosion, strength and weight requirements from said structural materials used in said lower region.

10. Building structure in accordance with claim 3 wherein said housing unit and said vertical poles have corrosion-resistant coatings.

11. Building structure in accordance with claim 3 wherein said housing unit further comprises structural materials in said upper region that are different from structural materials used in said lower region and which are also adapted to meet the different corrosion, strength and weight requirements from said structural materials used in said lower region.

12. Building structure in accordance with claim 1 wherein said vertical poles positioned within said guides in said corners of said housing unit are rigidly founded in the ground below said housing unit, and wherein said guides adjacent to said vertical poles that are adapted to interact with said vertical poles and maintain said housing unit in a substantially level orientation when water around said housing unit rises and lifts it from the ground during flooding, said rigidly founded vertical poles and said guides also being configured to act in concert with said upwardly tapered perimeter edges of said bottom surface of said base to prevent said building structure from experiencing lateral drift.

13. Building structure in accordance with claim 12 wherein said vertical poles each have an exterior surface and wherein said at least one rolling contact unit has multiple rollers with a shaft supported rigidly in relation to said housing unit, with said rollers also being positioned for rolling on said exterior surface of one of said vertical poles in a manner that achieves a precise and smooth vertical movement of said housing unit in relation to said vertical poles.

14. Building structure in accordance with claim 1 wherein said photovoltaic panels are adapted to generate direct current and further comprising batteries in said base that are adapted for storage of said direct current generated by said photovoltaic panels.

15. Building structure in accordance with claim 1 further comprising a water collection chamber and said roof having rain water collection gutters and channels leading rain water falling on said roof into said water collection chamber.

16. Building structure in accordance with claim 1 further comprising at least two fluid storage chambers and at least one pump adapted for transfer of fluid from one of said chambers to another in order to maintain said housing unit in a level and stable orientation.

17. Building structure in accordance with claim 1 further comprising public utility connections for electrical, water and sewer that are adapted for automatic disengagement when said housing unit deploys upwardly in response to rising flood water.

18. Building structure in accordance with claim 1 wherein said housing unit further comprises structural materials in said upper region that are different from structural materials in said lower region and also adapted to meet the different corrosion, strength and weight requirements.

19. Building structure in accordance with claim 1 wherein at least some of said chambers between adjacent ones of said aluminum and foam filled walls in said base are adapted for the collection of sewage, drinking water, fuel and other equipment necessary to make said building structure habitable.

20. Building structure in accordance with claim 1 further comprising additional vertical poles between said corners, and an additional guide for each said additional vertical pole that is fixedly secured by said pumped in foam within said aluminum and foam filled walls of said upper region and said base, said additional vertical poles and said additional guides being configured and positioned to work in concert with one another to assist in upward deployment of said housing unit from the ground during flooding.

* * * * *